US011578550B2

(12) United States Patent
Beach et al.

(10) Patent No.: US 11,578,550 B2
(45) **Date of Patent: *Feb. 14, 2023**

(54) DOWNHOLE DEVICE DELIVERY AND ASSOCIATED DRIVE TRANSFER SYSTEM AND METHOD OF DELIVERING A DEVICE DOWN A HOLE

(71) Applicant: REFLEX INSTRUMENTS ASIA PACIFIC PTY LTD, Balcatta (AU)

(72) Inventors: Andrew Phillip Beach, Balcatta (AU); Gavin Thomas McLeod, Balcatta (AU)

(73) Assignee: Reflex Instruments Asia Pacific Pty Ltd, Balcatta (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/462,384

(22) Filed: Aug. 31, 2021

(65) Prior Publication Data

US 2021/0396084 A1 Dec. 23, 2021

Related U.S. Application Data

(63) Continuation of application No. 16/652,913, filed as application No. PCT/AU2018/051076 on Oct. 3, 2018, now Pat. No. 11,136,842.

(30) Foreign Application Priority Data

Oct. 3, 2017 (AU) ..... 2017903988
Oct. 3, 2017 (AU) ..... 2017903989

(51) Int. Cl.
*E21B 23/00* (2006.01)
*E21B 17/046* (2006.01)
(Continued)

(52) U.S. Cl.
CPC ..... *E21B 23/00* (2013.01); *E21B 17/0465* (2020.05); *E21B 23/12* (2020.05);
(Continued)

(58) Field of Classification Search
CPC ..... E21B 23/00; E21B 17/0465; E21B 23/12; E21B 7/28; E21B 10/64; E21B 21/10; E21B 25/02; E21B 34/14; E21B 7/061
See application file for complete search history.

(56) References Cited

U.S. PATENT DOCUMENTS 1,532,917 A 4/1925 Meredith
1,720,998 A 7/1929 Campbell et al.
(Continued)

FOREIGN PATENT DOCUMENTS

EP 2 134 921 B1 9/2017
GB 709365 A 5/1954
(Continued)

OTHER PUBLICATIONS

International Search Report issued in PCT/AU2018/051076; dated Feb. 27, 2019.
(Continued)

*Primary Examiner* — Jonathan Malikasim
(74) *Attorney, Agent, or Firm* — Studebaker & Brackett PC

(57) ABSTRACT

A downhole device delivery and drive transfer system includes a sub which is arranged to attach to a drill string and a tool which is configured to enable it to travel through the drill string and releasably couple to the sub. The sub and the tool are arranged so that when they are releasably coupled to each other torque imparted to the drill string is transferred by the sub to the tool. The tool is arranged to carry one or more devices for performing one or more downhole functions such as core drilling, hole reaming or wedge placement for
(Continued)

directional drilling. The system also has a guide mechanism that operates between the sub and the tool to guide the tool to a known rotational orientation relative to the sub as the tool travels into the sub. A fluid control system controls the flow of fluid through the tool through a downhole outlet and a plurality of ports intermediate opposite ends of the tool.

15 Claims, 10 Drawing Sheets

(51) Int. Cl.

| | |
|---|---|
| ***E21B 23/12*** | (2006.01) |
| ***E21B 10/64*** | (2006.01) |
| ***E21B 21/10*** | (2006.01) |
| ***E21B 25/02*** | (2006.01) |
| ***E21B 34/14*** | (2006.01) |
| ***E21B 7/28*** | (2006.01) |

(52) U.S. Cl.
CPC ..... *E21B 7/28* (2013.01); *E21B 10/64* (2013.01); *E21B 21/10* (2013.01); *E21B 25/02* (2013.01); *E21B 34/14* (2013.01)

(56) References Cited

U.S. PATENT DOCUMENTS

| | | | | |
|---|---|---|---|---|
| 1,785,949 | A | 12/1930 | George | |
| 1,819,798 | A | 8/1931 | Stokes | |
| 2,153,815 | A | 4/1939 | Snyder | |
| 2,207,505 | A | 7/1940 | Bremner et al. | |
| 2,630,300 | A | 3/1953 | Emanuel | |
| 2,882,019 | A | 4/1959 | Carr et al. | |
| 3,346,059 | A | 10/1967 | Svendsen | |
| 3,433,313 | A | 3/1969 | Brown | |
| 3,955,633 | A | 5/1976 | Bowles | |
| 4,497,382 | A | 2/1985 | Nenkov | |
| 4,651,837 | A | 3/1987 | Mayfield | |
| 4,878,549 | A | 11/1989 | Bennet | |
| 5,351,765 | A * | 10/1994 | Ormsby | E21B 25/02 175/246 |
| 5,472,057 | A | 12/1995 | Winfree | |
| 6,173,796 | B1 * | 1/2001 | McLeod | E21B 10/64 166/117.5 |
| 6,615,933 | B1 | 9/2003 | Eddison | |
| 6,648,069 | B2 * | 11/2003 | Dewey | E21B 33/12 166/242.6 |
| 6,896,050 | B2 | 5/2005 | Biglin, Jr. et al. | |
| 7,066,270 | B2 * | 6/2006 | Murray | E21B 23/00 166/380 |
| 7,493,971 | B2 | 2/2009 | Nevlud et al. | |
| 8,051,925 | B2 | 11/2011 | Drenth | |
| 8,261,857 | B2 | 9/2012 | Able et al. | |
| 8,794,355 | B2 | 8/2014 | Drenth et al. | |
| 10,240,415 | B2 * | 3/2019 | Wolf | E21B 23/00 |
| 11,136,842 | B2 * | 10/2021 | Beach | E21B 7/061 |
| 2002/0185312 | A1 | 12/2002 | Armell et al. | |
| 2009/0250224 | A1 | 10/2009 | Wright et al. | |
| 2011/0079435 | A1 | 4/2011 | Drenth et al. | |
| 2017/0101829 | A1 | 4/2017 | Heide et al. | |
| 2022/0275688 | A1 * | 9/2022 | Beach | E21B 10/64 |

FOREIGN PATENT DOCUMENTS

| | | | |
|---|---|---|---|
| WO | 2013/028075 | A1 | 2/2013 |
| WO | 2017/079801 | A1 | 5/2017 |

OTHER PUBLICATIONS

The extended European search report issued by the European Patent Office dated May 4, 2021, which corresponds to 18864796.0-1002 and is related to U.S. Appl. No. 16/652,913.
Longyear Wireline Casing Advancer Product Sheet; 2 pages; published 1988.
Boart Longyear Wireline Casing Advancer Catalog: Operations and Service Manual; 29 pages; published Apr. 1998.
Boart Longyear In-Hole Tools Catalog; 3 pages; published 2016.

* cited by examiner

DOWNHOLE DEVICE DELIVERY AND ASSOCIATED DRIVE TRANSFER SYSTEM AND METHOD OF DELIVERING A DEVICE DOWN A HOLE

TECHNICAL FIELD

A downhole device delivery and associated drive system is disclosed. A method of and tool for delivering a device down a hole is also disclosed. The system, method and tool may for example enable the changing of a coring or non coring drill bit, or sampling or non-sampling fluid driven hammer bit, or facilitate a change in direction of drilling without the need to pull a drill string from a borehole.

BACKGROUND ART

When drilling a borehole over any reasonable depth for example boreholes for surveying, exploration or production, the drill bit will need replacement due to wear or changes in downhole geology. This requires the drill string, to which the drill bit is connected, to be pulled from the borehole. The drill string may be kilometres in length and made up from individual drill rods of a nominal length such as 6 m. Therefore, to replace the drill bit, each drill rod needs to be decoupled from the drill string one by one. Once the drill bit has been reached and replaced the drill string is reconstructed one rod at a time until the bit reaches the toe of the borehole, so drilling can recommence. This process, known as "tripping the string", may take more than 24 hours, depending on the borehole depth.

However tripping the string is not limited to only changing the drill bit. This may also be required for the purposes of replacing reamer bits and subs to help keep the gauge of the hole the correct diameter, or connecting directional wedges or other steering mechanisms to the drill string to facilitate a change in drilling direction.

U.S. Pat. No. 3,955,633 proposes a system ("the Mindrill") which enables the changing of a drill bit without the need to trip a drill string. The Mindrill system uses a downhole tool with drive dogs that need to engage in holes formed in a lower most pipe of the drill string to facilitate a transferring torque from the drill string to the cutting bit. The drive dogs are biased outwardly from a tubular housing by springs. As the tool descends through the drill string the dogs are held back against the bias by cams on an inner tubular dog cradle. The Mindrill tools lands on an internal shoulder of the drill string in a random orientation.

To engage the drive dogs in the holes in the drill string, firstly the dogs are released from the cams by relative axial movement of the cradle. This allows the springs to push the dogs outwardly through slots in the tool. Now the drill string must be rotated relative to the tool. This should eventually bring the dogs into registration with the holes where the springs act to snap the dogs into the holes. To allow for some vertical misalignment during this process the length of the holes is greater than the length of the dogs so if and when the dogs spring into the holes there is a gap between them.

The Mindrill tool also operates to install reamer bit pads immediately adjacent the downhole end of the lower most drill rod. The reamer bit pads are pushed outwardly into position by a sliding tubular member. However, no mechanism is described for verifying that the Mindrill tool has engaged the drill string. It is believed because of this that there is an elevated risk of misalignment between the drive dogs and reamer pads and corresponding parts of the drill string/drive system that may result in severe damage to these component parts as well as loss of a core sample.

During drilling, water is pumped down the string and flows through the tool and the tubular member to the drill bit at the end of the tool. Therefore, the water bypasses the reamer bit pads. This may be problematic in broken or fractured ground conditions. During drilling fluid is pumped through the drill string for several purposes including flowing back up in the annulus between the drill string and the borehole for the purposes of cooling, cleaning and lubricating the reamer pads which are up hole of the drill bit. In broken or fractured ground, the fluid may either be lost through the borehole before reaching the reamer pads, or is provided with insufficient volume and all consistency to perform its intended functions in connection with the reamer pads. This would result in excessively high drill torque and in-hole rod chatter reducing drill productivity as well as excessive wear and damage to the reamer bit pads.

The above references to the background art do not constitute an admission that the art forms a part of the common general knowledge of a person of ordinary skill in the art. The above references are also not intended to limit the application of the system and method as disclosed herein.

SUMMARY OF THE DISCLOSURE

In one aspect there is disclosed a tool for delivering one or more devices for performing one or more downhole functions through a drill string comprising:

- a main body arranged to carry one or more devices thought the drill string;
- a key on the main body arranged to cooperate with a guide surface supported by the drill string wherein the key contacts the guide surface as the tool travels toward a down hole end of the drill string to guide the tool to a known rotational orientation relative to the guide surface;
- wherein the key and guide surface cooperate so that torque imparted to the drill string is transferred by the guide surface and the key to the main body and the one or more devices.

In one embodiment the main body has the one or more openings through which respective ones of the devices in the form of members can extend in a radial direction beyond an outer circumferential surface of the drill string.

In one embodiment the members comprise reamer blocks or pads.

In one embodiment the tool comprises an inner control shaft axially movable relative to the main body wherein the inner control shaft is movable between a first position in which the inner control shaft urges the members through the openings in the main body and into an engagement position where the members extend radially beyond the outer circumferential surface of the drill string and a second position in which the members are able to retract radially inward of to the main body to enable passage of the tool through the drill string.

In one embodiment the inner control shaft is provided with a ramp surface on which the members ride when the control shaft is moved axially between the first and second positions.

In one embodiment the tool comprises a fluid flow control system enabling control of the flow of fluid through the tool, the flow control system having a pump in mode enabling fluid to flow into but not out of the tool; an operating mode enabling fluid to flow in an axial direction through the tool; and a trip out mode enabling fluid to flow out of the tool through one or more bypass ports at a location intermediate of opposite axial ends of the tool.

In one embodiment the fluid flow control system is arranged, when in the drilling mode, to enable a portion of fluid flowing through one or more bleed holes in the inner control shaft and exit the tool at a location adjacent the members.

In one embodiment the fluid flow control system comprises a fluid flow path formed axially in the tool having one or more inlet openings at an up hole end, a main outlet at a downhole end axially aligned with the fluid flow path, and a one-way valve in the main outlet, the one-way valve configured to open when pressure exerted by fluid in the tool exceeds a predetermined pressure.

In one embodiment the main body forms a part of the fluid flow control system wherein when the fluid flow control system is in either the pump in mode or the trip out mode an inner surface of the main body overlies and closes the one or more bleed holes.

In one embodiment the main body and inner control shaft are each provided with a plurality of the bypass ports, and wherein the bypass ports on the main body and the inner control shaft are misaligned when the fluid control system is in the operating mode wherein fluid in the tool is unable to flow out through the bypass ports, and wherein the bypass ports on the main body and the inner control shaft are aligned with each other in the trip out mode enabling fluid in the tool to flow out of the tools through the bypass ports.

In one embodiment the tool comprises a sleeve inside and movable relative to the inner control shaft, the sleeve being provide with a plurality of ports through which fluid entering through the one or more inlet openings can flow to the outlet.

In one embodiment the flow control system is in the pump in mode the sleeve overlies and closes the bypass ports in the inner control shaft, and when the flow control system is in the trip out mode the sleeve is moved relative to the main body and the inner control shaft to uncover the bypass ports enabling fluid to flow out of the tool through the bypass ports at a location intermediate of opposite axial ends of the tool.

In one embodiment the tool comprises a seal arrangement supported on the main body and arranged to form a seal against an inside surface of a drill string, the seal arrangement located on the tool intermediate the one or more inlet openings and the bypass ports on the main body and wherein the fluid control system is in the trip out mode fluid passing through the inlet of the tool is able to flow out of the tool through the bypass ports.

In one embodiment the tool comprises a locking system having a travel state arranged to lock the inner control shaft in the second position while the tool travels through the drill string.

In one embodiment the locking system has a latching state releasably latching the tool at a downhole end of the drill string.

In one embodiment the locking system comprises one or more locking balls retained by and seated in the main body and a recess formed on an outer circumferential surface of the control shaft, the locking balls arranged to contact the outer circumferential surface of the inner control shaft, wherein when the locking system is in the travel state the inner control shaft is located so that the locking balls are able to retract into the recess formed on the outer circumferential surface; and when the locking system is in the locking state the inner control shaft is moved axially relative to the main body so that the locking balls roll out the recesses and are pushed in a radial outward direction.

In one embodiment one of the one or more devices comprise a wedging system arranged to contact a surface of, or be suspended in, a hole being drilled by the drill string to facilitate a change in direction of drilling of the hole.

In one embodiment one of the one or more devices carried by the tool comprise a drill bit.

In one embodiment one of the one or more devices carried by the tool comprises: (a) a fluid driven hammer drill system having a hammer bit; or (b) a core drilling system having a core bit.

In a second aspect there is disclosed a downhole device delivery and drive transfer system comprising:

a sub arranged to attach to a drill string;

a tool according to the first aspect configured to travel through a drill string and into the sub when attached to the drill string; wherein the guide surface is formed on the drive sub.

In one embodiment the sub comprises a continuous outer circumferential surface.

In one embodiment the members are arranged to engage the sub to facilitate transfer of weight of the drill string onto a downhole end of the tool or a device coupled to a downhole end of the tool.

In one embodiment the sub is provided with a plurality of recesses in a down hole each for receiving respective ones of the members.

In a third aspect there is disclosed a method of delivering a device to a downhole end of a drill string and transferring torque from the drill string to the device the method comprising: attaching a sub to the downhole end of the drill string;

placing the drill string in a borehole;

delivering a tool through a drill string wherein the tool is arranged to carry one or more devices, systems or products through the drill string;

releasably coupling the tool to the sub in a fixed and known rotational relationship to each other; and transferring torque applied to the drill string to the one or more devices, systems or products through the sub and tool.

In one embodiment the method comprises providing the device as a wedging system arranged to extend from the sub and contact a surface of, or be suspended in, the borehole.

In one embodiment the method comprises providing the device as one of: a core drilling system; and, a fluid driven hammer drill system.

In one embodiment the method comprises using the tool according to the first aspect to deliver the one or more device, system more product to the downhole end of the drill string.

In a fourth aspect there is disclosed a downhole device delivery and drive transfer system comprising:

a sub arranged to attach to a drill string;

a tool configured to travel through a drill string and into the sub when attached to the drill string; and a guide mechanism operable between the sub and the tool to guide the tool to a known rotational orientation relative to the sub as the tool travels into the sub, at which the tool is able to releasable couple to the sub so that torque imparted to the drill string is transferred by the sub to the tool, the tool further being arranged to carry one or more devices for performing one or more downhole functions.

In one embodiment the guide mechanism comprises an edge supported by the sub and a portion of the tool wherein the tool is able to rotate about a longitudinal axis on engagement of the edge with the portion to guide the tool to the known rotational orientation relative to the sub.

In one embodiment the sub comprises a continuous outer circumferential surface.

In one embodiment the sub and the tool together form a torque transmission system which releasably couples the sub to the tool and facilitates transfer of torque from the sub to the tool, the torque transmission system comprising one or more recesses in or on the sub and wherein the portion is arranged to seat in respective openings when the tool is in the known rotational orientation.

In one embodiment the tool has a main body having the one or openings through which respective devices in the form of members can extend in a radial direction to engage the sub.

In one embodiment the tool comprises an inner control shaft axially movable relative to the main body wherein the inner control shaft is movable between a first position in which the inner control shaft urges the members through the openings in the main body and into an engagement position where the members are able to engage recesses in or on the sub and a second position in which the members are able to retract from the recesses in or on the sub and to enable passage of the tool through the drill string.

In one embodiment members are arranged to extend radially beyond an outer circumferential surface of the sub when the tool is coupled to the sub.

In one embodiment the members comprise reamer blocks or pads.

In one embodiment each member comprises a reamer support body and a reamer block or pad fixed to the reamer support body.

In one embodiment the members are arranged to engage the sub to facilitate transfer of weight of the drill string onto a downhole end of the tool.

In one embodiment the inner control shaft is provided with a ramp surface on which the members ride when the control shaft is moved axially between the first and second positions.

In one embodiment the system comprises a fluid flow control system enabling control of the flow of fluid through the tool, the flow control system having a pump in mode enabling fluid to flow into but not out of the tool; a drilling mode enabling fluid to flow in an axial direction through the tool; and a trip out mode enabling fluid to flow out of the tool through one or more bypass ports at a location intermediate of opposite axial ends of the tool.

In one embodiment the fluid flow control system is arranged, when in the drilling mode, to enable a portion of fluid flowing through one or more bleed holes and exit the tool at a location adjacent the members.

In one embodiment the fluid flow control system comprises a fluid flow path formed axially in the tool having one or more inlet openings at an up hole end, a main outlet at a downhole end axially aligned with the fluid flow path, and a one-way valve in the main outlet, the one-way valve configured to open when pressure exerted by fluid in the tool exceeds a predetermined pressure.

In one embodiment the one or more bleed holes are formed in the circumferential wall of the control shaft.

In one embodiment the main body is further arranged to form a part of the fluid flow control system wherein when the fluid flow control system is in either the pump in mode or the trip out mode an inner surface of the main body overlies and closes the one or more bleed holes.

In one embodiment the system comprises a seal arrangement supported on the tool and arranged to form a seal against an inside surface of a drill string, the seal arrangement located on the tool intermediate the one or more inlet openings and the main outlet and wherein the seal arrangement comprises at least one pump-in seal extending about the tool.

In one embodiment the seal arrangement comprises at least two pump-in seals extending about the tool and arranged to interlock with each other.

In one embodiment a first of the pump-in seals comprises a downhole end provided with a recess which opens onto an inner circumferential surface of the first pump in seal, and a second of the pump in seals comprises a tubular portion having an end arranged to seat in the recess of the first pump in seal.

In one embodiment the system comprises a locking system arranged to lock the control shaft in the second position while the tool travels to the drill string.

In one embodiment the locking system comprises one or more locking balls retained by the main body and corresponding ball recesses formed in the control shaft, the locking system arranged so that prior to the members reaching the engagement position the locking balls are maintained in the ball recesses by contact with an inner surface of the drill string to axially lock the main body to the control shaft.

In one embodiment the device comprise a wedging system arranged to contact a surface of, or be suspended in, a hole being drilled by the drill string to facilitate a change in direction of drilling of the hole.

In one embodiment the wedging system is arranged to extend beyond a downhole end of the sub.

In one embodiment the wedging system is located at a known and fixed rotational position relative to the sub when the tool is coupled to the sub.

In one embodiment the device carried by the tool comprises a drill bit.

In one embodiment the device further comprises an outer core barrel to which the drill bit is coupled.

In one embodiment the one or more devices carried by the tool comprises a fluid driven hammer drill system and the drill bit is a hammer bit or a core drilling system and the drill bit is a core bit.

In a fifth aspect there is disclosed a method of delivering a device to a downhole end of a drill string and transferring torque from the drill string to the device the method comprising:

attaching a sub to the downhole end of the drill string;

placing the drill string in a borehole;

delivering a tool through a drill string wherein the tool is arranged to carry one or more devices, systems or products through the drill string;

releasably coupling the tool to the sub in a fixed and known rotational relationship to each other, and wherein torque when applied to the drill string is transferred by the sub and the tool to the device.

In one embodiment the method comprises providing the device as a wedging system arranged to extend from the sub and contact a surface of, or be suspended in, the borehole.

In one embodiment the method comprises providing the device as one of: a core drilling system having an outer barrel, and inner core barrel and a core bit; and, a fluid driven hammer drill system.

In a sixth aspect there is disclosed a downhole drilling system for drilling a bore hole comprising:

a tool configured to travel through, and releasably latch at a down hole end of, a drill string, the tool carrying an outer barrel having a drill bit coupled to one end, and a plurality of reamer pads, the tool also provided with a fluid control system enabling control of flow of a fluid into the tool, the flow control system having a drilling mode enabling a first portion of the fluid flowing into the tool to flow in an axial direction through the tool and out from the outer barrel at location adjacent the drill bit and a second portion of the fluid to flow out of the tool from a location adjacent the reamer pads; and wherein the tool together with the outer barrel, drill bit and reamer pads is retrievable through the drill string while the drill string remains in a borehole drilled by the drilling system.

In one embodiment the tool comprises a fluid inlet at an up-hole end enabling fluid to enter the tool; a fluid outlet at a downhole end of the tool and a one way valve allowing fluid to flow out from the outlet when the fluid is of a pressure greater than a predetermined pressure; and one or more other openings at locations intermediate of up hole and down hole end of the tool.

In one embodiment the other openings comprise bypass ports which are arranged to open when the tool is being retrieved from the drill string and that allow fluid that enters through the inlet to flow out of the tool at a corresponding intermediate location.

In one embodiment the other openings comprise bleed holes arranged to enable the second portion of fluid to flow out of the tool from the location adjacent the reamer pads.

In one embodiment the tool comprises a main body; and an inner control shaft axially movable relative to the main body and wherein the other openings comprise a one or more bypass ports in the main body and one or more bypass ports in the inner control shaft; wherein the bypass ports on the main body and the inner control shaft register with each other when tool is being retrieved from the drill string.

In one embodiment the tool comprises a fluid inlet body coupled to the inner control shaft and provided with the inlet.

In one embodiment the tool comprises a sleeve inside and movable relative to the control shaft, the sleeve being provide with a plurality of ports through which fluid entering through the inlet can flow to the outlet.

In one embodiment the flow control system in addition to the drilling mode has a pump in mode enabling fluid to flow into but not out of the tool and wherein the bypass tube covers the bypass ports; and a trip out mode wherein the bypass tube uncovers the bypass ports enabling fluid to flow out of the tool through the bypass ports at a location intermediate of opposite axial ends of the tool.

In one embodiment the system comprises a sub arranged to attach to the drill string, and a guide mechanism operable between the sub and the tool to guide the tool to a known rotational orientation relative to the sub as the tool travels into the sub, at which the tool is able to releasable couple to the sub so that torque imparted to the drill string is transferred by the sub to the drill bit and reamer pads.

In a seventh aspect there is disclosed a tool for delivering a device through a drill string comprising:

a main body provided with a fluid outlet at one end, one or more bypass ports located between opposite ends of the main body;

an inner control shaft inside of and axially movable relative to the main body, the inner control shaft having one or more bypass ports and one or more bleed holes in board of opposite ends of the inner control shaft; and a sleeve inside of and movable relative to the control shaft;

wherein at least one or the main body and the inner control shaft is arranged to carry one or more devices for performing one or more downhole functions.

In one embodiment the tool comprises a fluid flow control system enabling control of the flow of fluid through the tool, the flow control system having a first mode enabling fluid to flow into but not out of the tool body, and a second mode enabling fluid to flow out from the main outlet and the one or more bleed holes.

In one embodiment the main body has one or more bypass ports located between opposite ends thereof, the inner control shaft having one or more bypass ports, and wherein the flow control system has a third mode enabling fluid to flow out of the main body through the bypass ports in the main body and the inner control shaft.

In one embodiment the fluid flow control system comprises a one-way valve in the main outlet, the one-way valve configured to open when pressure exerted by fluid in the tool exceeds a predetermined pressure.

In one embodiment the main body is further arranged to form a part of the fluid flow control system wherein when the fluid flow control system is in the first mode an inner surface of the main body overlies and closes the one or more bleed holes.

In one embodiment the sleeve forms part of the fluid control system and when the fluid control system is in the first mode the sleeve overlies and closes the bypass ports.

In one embodiment the device comprises: a fluid driven hammer drill system; or a core drilling system having an outer barrel, and inner core barrel and a core bit.

In one embodiment the device further includes one or more reamer pads.

In an eighth aspect there is disclosed a method of drilling a bore hole in the ground comprising:

placing a drill string in the borehole;

drilling a portion of the borehole using one of: a fluid driven hammer drill system; and a core drilling system detachably coupled to the drill string;

retrieving, through the drill string while the drill string remains in the borehole, the system used to drill the portion of the borehole;

delivering the other one of the fluid driven hammer drill system and the core drilling system through, and coupling it to, the drill string;

drilling a next portion of the borehole using the other one of the fluid driven hammer drill system and the core drilling system.

In one embodiment the method comprises using a tool to deliver and retrieve the fluid driven hammer drill system or the core drilling system as the case may be.

In one embodiment the method comprises using a downhole device delivery and drive transfer system to deliver and retrieve the fluid driven hammer drill system or the core drilling system as the case may be, wherein the one or devices are constituted by the fluid driven hammer drill system or the core drilling system.

BRIEF DESCRIPTION OF THE DRAWINGS

Notwithstanding any other forms which may fall within the scope of the system and method as set forth in the Summary, specific embodiments will now be described, by way of example only, with reference to becoming drawings in which.

DETAILED DESCRIPTION OF SPECIFIC EMBODIMENTS

Figure 2:
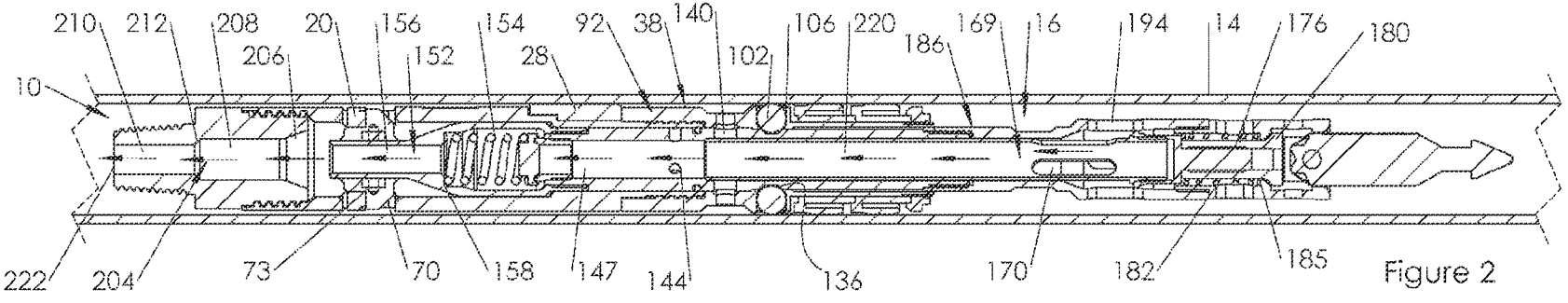
FIG. 2 is a longitudinal section view of the tool shown in FIG. 1 when in a pump in mode and travelling through a drill string.
Figure 3:
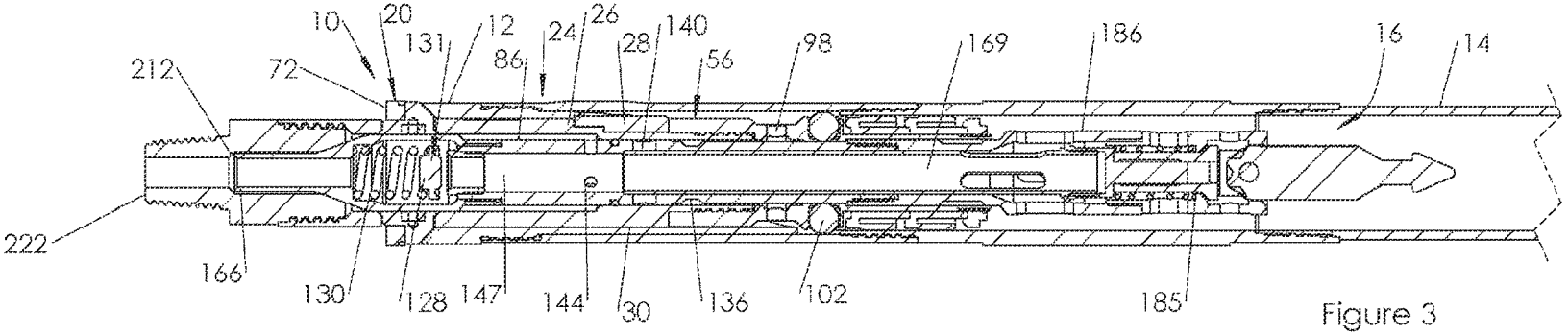
FIG. 3 is a longitudinal section view of the tool shown in FIGS. 1 and 2 together with a sub incorporated in the embodiment of the disclosed system attached to a downhole end of the drill string and with the tool engaged with the sub and in a drilling mode.
Figure 4:
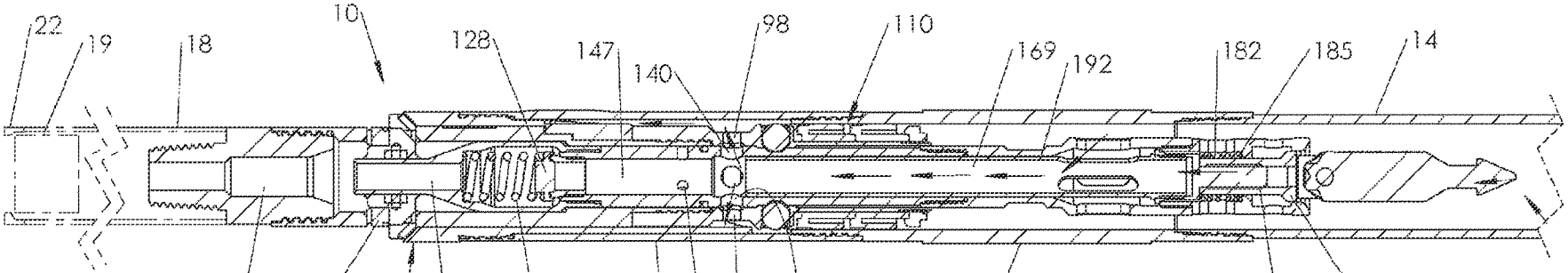
FIG. 4 this is a representation of the system shown FIG. 3 when in a retrieval mode.

FIGS. 1-5*b* depict an embodiment of the downhole device delivery and drive transfer system 10 (hereinafter to in general as "system 10"). The system comprises a sub 12 which is arranged to attach to a drill string 14 and a tool 16 which is configured to enable it to travel through the drill string 14 and releasably couple to the sub 12. As explained in greater detail later the sub 12 and the tool 16 are arranged so that when they are releasably coupled to each other torque imparted to the drill string is transferred by the sub 12 to the tool 16. The tool 16 is arranged to carry one or more devices for performing one or more downhole functions. In the presently illustrated embodiment, having a core drilling application, the devices carried by the tool 16 is a core drilling system which includes an outer core barrel 18, and inner core tube 19 (FIG. 4). The devices may also or alternately include a plurality of members 20. As explained later below the members 20 may carry or comprise reamer pads, but in alternate embodiments the members may not carry reamer pads, and can act solely for the purpose of coupling torque to the tool 16. The drill string torque is subsequently transferred by the tool 16 to members 20 and the outer core barrel 18. As understood by those skilled in the art, for a core drilling application, the inner core tube 19 while being carried by the tool 16, is rotationally decoupled from the outer core barrel 18.

When used in a core drilling application the outer core barrel 18 is provided with a core bit 22 (FIG. 4). The outer core barrel 18, core bit 22 and inner core tube 19 are of conventional construction and functionality which is well understood by those skilled in the art and therefore is not described in greater detail here. Suffice to say that when the system 10 is used in a core drilling application of core bit 22 cuts a core sample of the ground which progressively feeds into and inner core tube 19. When the present embodiment of the tool 16 is retrieved from the drill string it carries with it the outer core barrel 18, the inner core tube 19, the bit 22 and the members 20. The outer core barrel 18 can be disconnected from the tool 16 or otherwise opened and the inner core tube 19 accessed to retrieve the core sample.

The system 10 also has a guide mechanism 24 that operates between the sub 12 and the tool 16 to guide the tool 16 to a known rotational orientation relative to the sub 12 as the tool 16 travels into the sub 12. The guide mechanism 24 is formed by an edge or guide surface 26 provided inside the sub 12 and a portion 28 (which may also be considered or designated as a "key") of the tool 16.

Figures 5A, 5B:
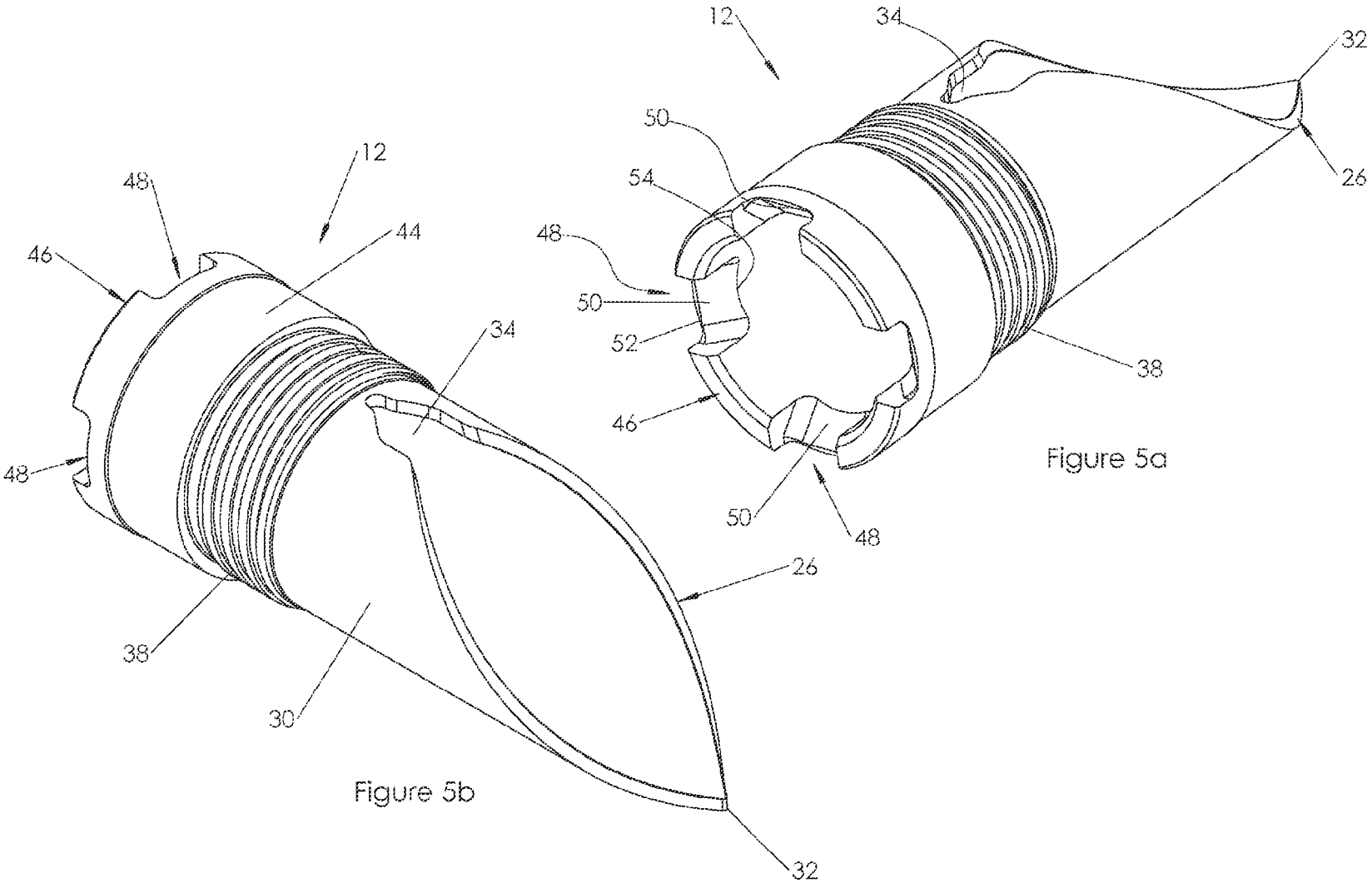
FIG. 5*a* is an isometric view from a first angle of the sub incorporated in the disclosed system.
FIG. 5*b* is an isometric view from a second angle of the sub shown in FIG. 5*a;*

With reference to FIGS. 5*a* and 5*b* in this embodiment the edge 26 is provided as a part or an extension of the sub 12. The edge 26 is formed as the edge of a tubular structure 30 (known in the art as a "mule shoe") coaxial with the sub 12 and has a small rounded peak 32 and smoothly curves in opposite directions about the tubular structure 30 leading to a socket 34. The socket 34 and the peak 32 are diametrically opposed.

Figure 6:
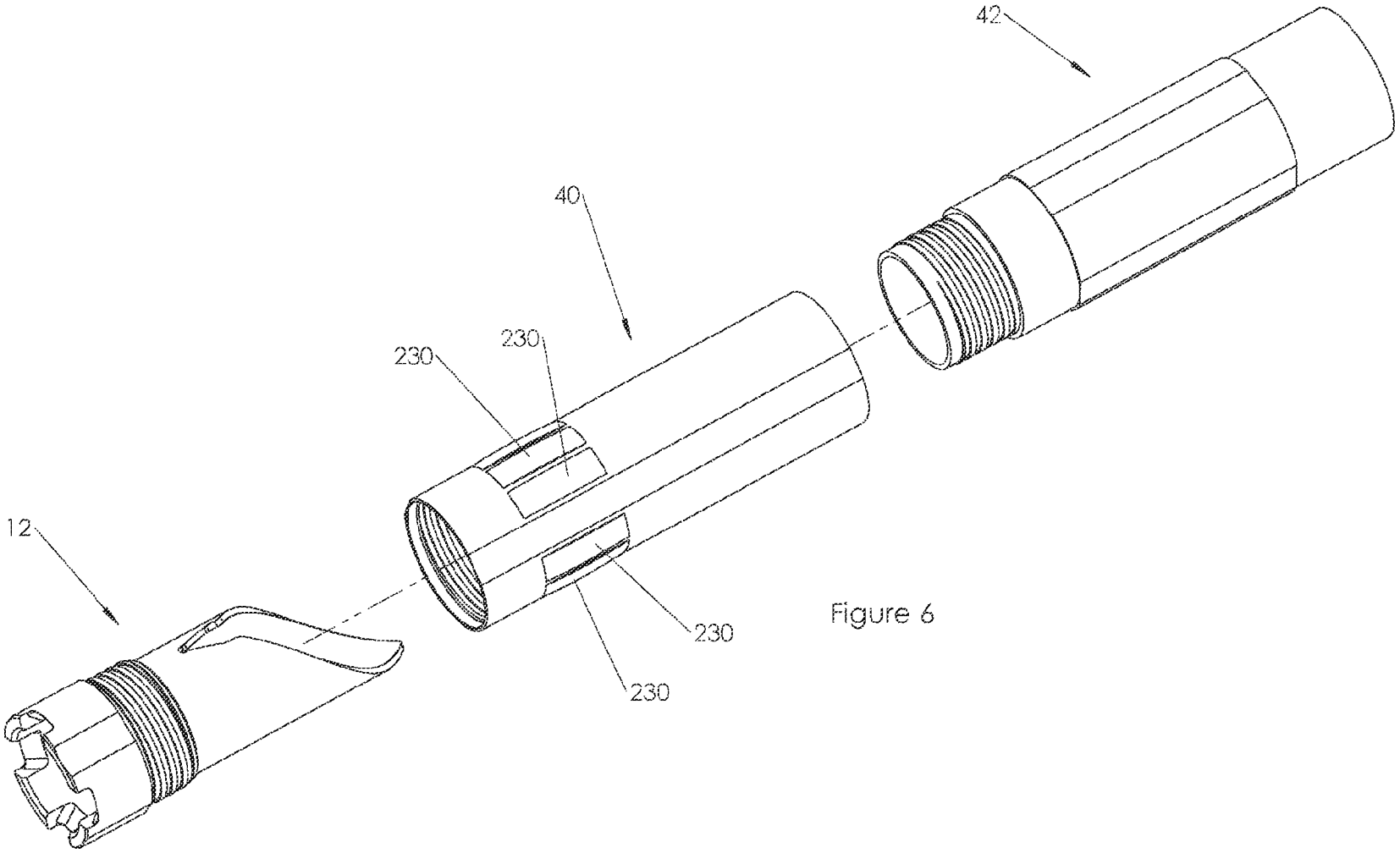
FIG. 6 is an exploded view of the sub shown in FIGS. 5*a* and 5*b*, together with a reamer sub and the adapter sub which are used to couple the sub to a downhole end of the drill string.

The sub 12 is formed with a thread 38 intermediate of its length for connection to a standard reamer sub 40. The reamer sub 40 is in turn attached to an adapter sub 42 (see FIGS. 4 and 6). The adapter sub 42 is connected to the downhole end of the drill string 14. The drill string 14 is made up from a number of end to end connected drill pipes in a standard manner and has a construction which is of no consequence to the operation of the system 10 except that it provides a structure to which the sub 12 is connected and a conduit through which the tool 16 can travel.

The sub 12 has a body portion 44 formed with a downhole edge 46. The edge 46 is provided with a plurality of circumferentially spaced recesses 48 that open onto the edge 46, in effect forming a castellated end. Recesses 48 are formed with tapered faces 50 which reduce in inner diameter in a direction from a downhole edge 52 of the face 50 to an up-hole edge 54 on an inner radius of the sub 12. It will also be noted that in this embodiment the sub 12 has, notwithstanding its complex shape and configuration, a continuous surface inboard of its axial edges. That is, there are no holes or slots wholly inboard of the edges 26 and 46. Accordingly fluid flowing through the sub 12 can only flow out by passing the edges 26 or 46 rather than through some internal path between these two edges.

The portion 28 which interacts with the edge 26 to form the guided mechanism 24 is in the form of a key configured to seat in the socket 34. The key 28 is a component of the tool 16 and shown most clearly in FIGS. 1 and 7. The key 28 has a rounded down hole end which is configured to contact and subsequently slide along and down the edge 26 to the socket 34. Engagement of the tool 16/key 28 with the socket 34 of mule shoe 30 ensures correct alignment of the members 20 with the recesses 48 in the drive sub. Additionally the correct alignment of the tool via the mule shoe also allows for a positive fluid seal between the outer circumferential surface of the tool 16 and the inner circumferential surface of the drill string/sub 40 which assists in providing a fluid pressure spike or increase indication to a drill operator that the tool 16 is correctly seated and ready for drilling. (As explained later this pressure spike is also facilitated by a one-way valve 131.)

The tool 16 is constructed from a number of interconnected components. These components include:

a main body 56;

a control shaft 58 coaxial with and inside of the main body 56;

a sleeve 60 coaxial with and inside the control shaft 58.

Main Body 56

The main body 56 is itself composed of a number of parts. These parts include a reamer body 62 in the form of a tube having a reduced diameter spigot 64 with a screw thread 66 at an up-hole end and an internal thread (not shown) at a downhole end 68. The down hole end 68 forms a fluid outlet of the main body. A plurality of internal slots 70 are formed in the reamer body 62. The slots 70 are configured to enable members 20 to extend or retract in a radial direction into and out of the slots 70.

Figure 8A:
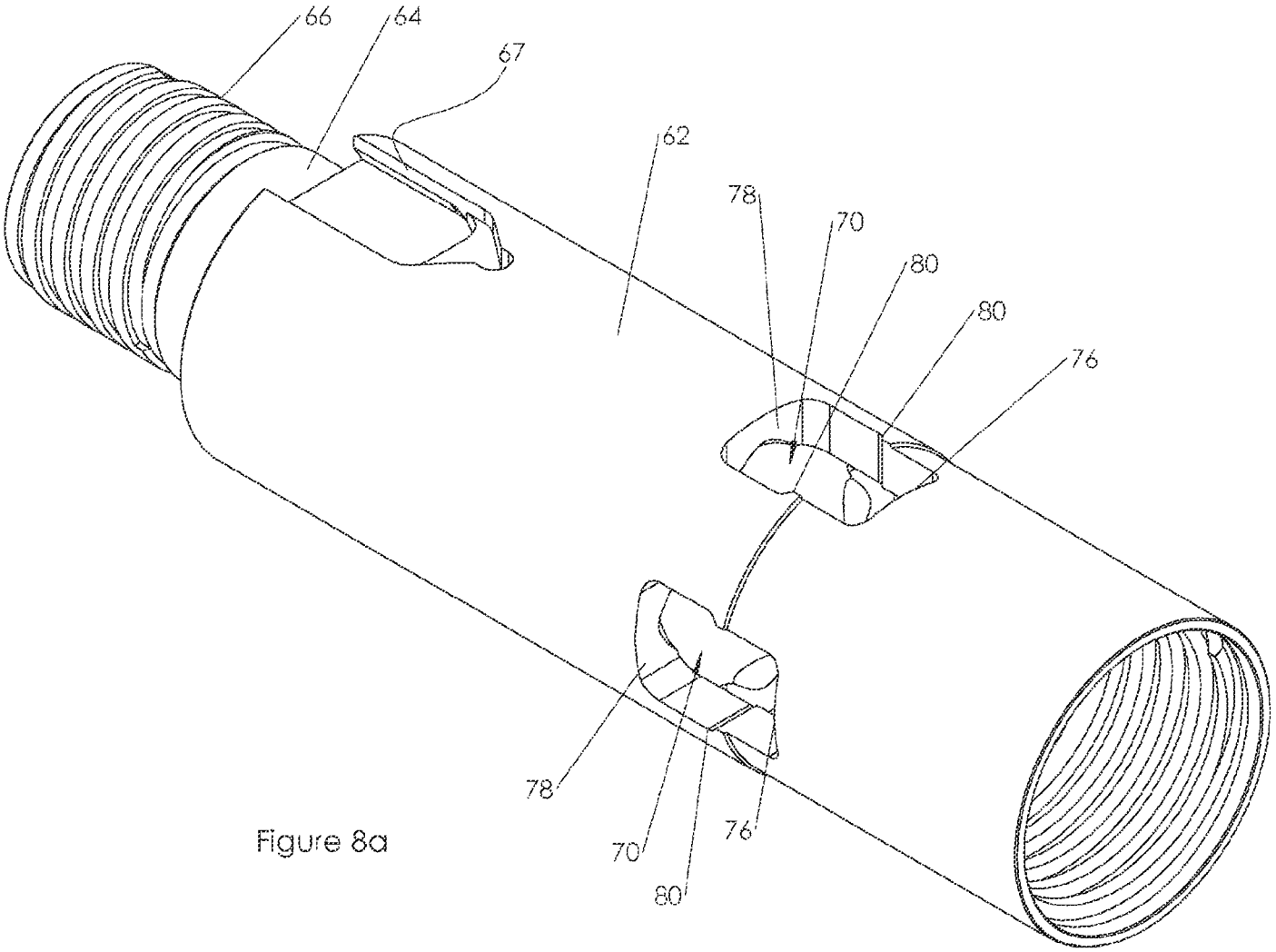
FIG. 8*a* is an isometric view of a reamer body incorporated in the tool.
Figure 8B:
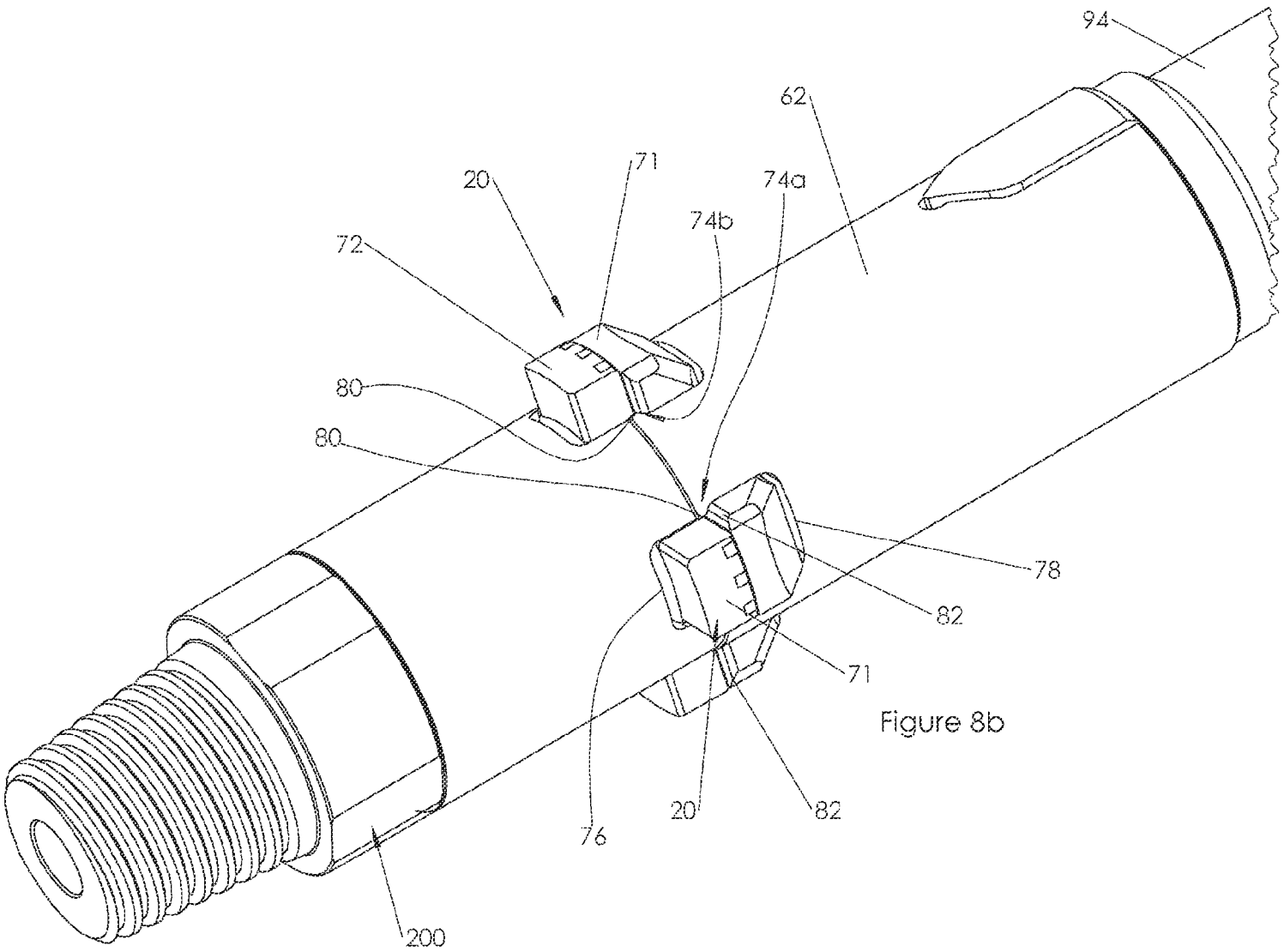
FIG. 8*b* is a schematic representation of a downhole end of the tool when in the drilling mode and showing members used for transferring torque and supporting reamer pads extending through slots and the reamer body.

As shown most clearly in FIGS. 8*a* and 8*b* the slots 70 and the members 20 are relatively configured to abut each other at one or more (in this instance two) locations 74*a* and 74*b* intermediate the axially opposite ends of the slot 70. This prevents the members 20 from sliding in an axial direction when subjected to wear. The relative configuration of the slots 70 is by way of forming the slots 70 with a downhole portion 76 having a smaller arc length than an up-hole portion 78 thereby creating an internal shoulder 80 in the slots 70. The relative configuration of the members 20 is by providing them with opposed shoulders 82. The shoulders 82 engage with the shoulders 80 thereby preventing the axial motion.

FIG. 8*a* also clearly shows a recess 67 in which the key 28 is fixed.

Figure 9A:
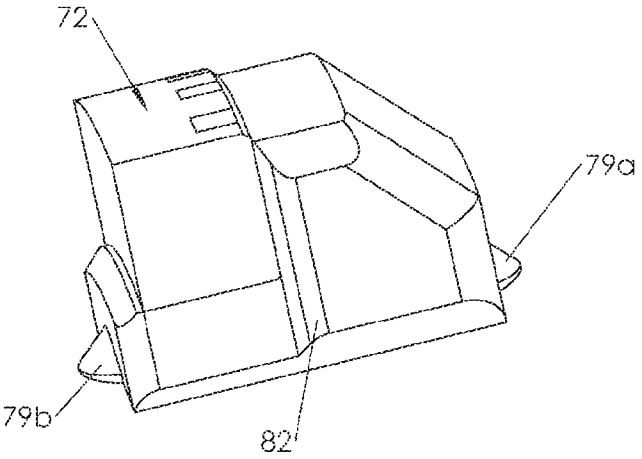
FIG. 9*a* is an isometric view of a member incorporated in the system.
Figure 9B:
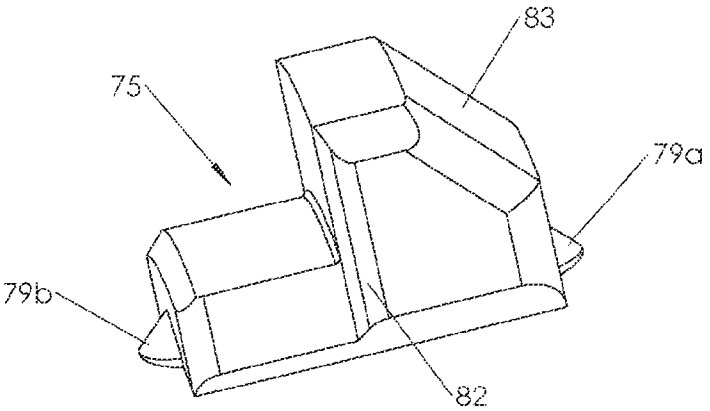
FIG. 9*b* is an isometric view of the member shown in FIG. 9*a*. without an associated reamer pad.
Figure 9C:
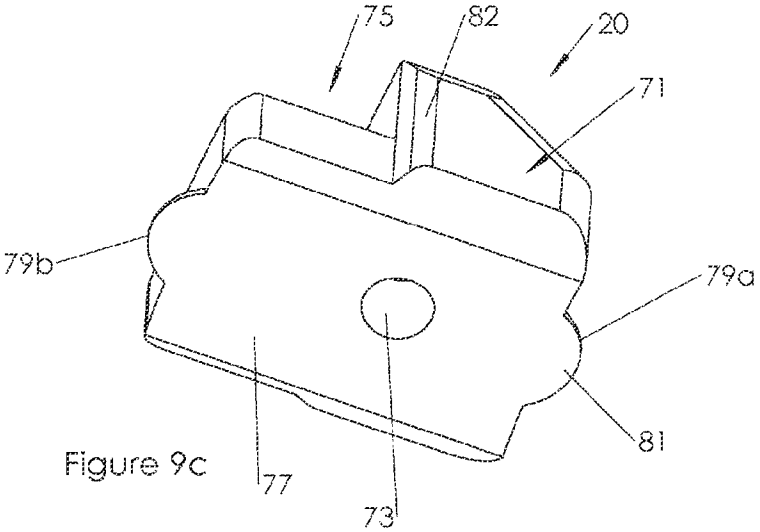
FIG. 9*c* is an isometric view from the bottom of the member shown in FIG. 9*b;*

With reference to FIGS. 9*a*-9*c* each member 20, in this embodiment, is made of three parts, a reamer support body 71, a reamer pad bit 72 and a magnet 73. The reamer pad bit 72 is fixed to a recess seat 75 formed in the body 71. The magnet 73 is retained within a hole formed in a curved base 77 of the body 71. The member 20 is formed with lips 79*a* and 79*b* that extend axially from respective opposite ends of the base 77. The lip 79*a* has a ramp surface 81 formed with progressively increasing radius relative to the base 77 when looking in an up-hole direction. The shoulders 82 lie on opposite sides of the body 71 and slightly up hole of the reamer pads 72. The body 71 is also formed with a tapered surface 83 extending between the opposite shoulders 82 and leading to the lip 79*a*.

The body 71 may be made as a block of a metal or metal alloy whereas the reamer pads 72 may be made from a diamond matrix material. In another embodiment which is not illustrated, the entirety of the member 20 except for the magnet 73 may be made as a single block of diamond matrix material, or other material which is suitable to provide the member 20 with a reaming capability and function.

Returning to FIG. 7 the main body 56 has an internal passage 84 with a downhole portion 86 that contains the slots 70 having an increased inner diameter with reference to a contiguous up hole portion 88.

Screwed onto the spigot 64 and forming part of the main body 56 is a tubular upper body portion 92. This is formed with a skirt 94 and a plurality of circumferentially space facets 96 in which a plurality of bypass ports 98 is formed. Up hole of the ports 98 is a circumferential ball seat 100 for seating respective locking balls 102. The seat 100 is provided with radial holes in which the balls 102 sit and can contact the inner control shaft 58. The tubular spigot 104 extends from the ball seat 100. A locking ball sleeve 106 fits over the spigot 104 and has a respective slot 108 (see FIGS. 1 and 10) for each locking ball 102. The slot 108 overhangs its corresponding locking ball 102 when a tool 16 is assembled preventing the locking ball 102 from falling out while allowing radial extension of the balls 102 beyond an outer circumferential surface of the sleeve 106.

Figure 1:
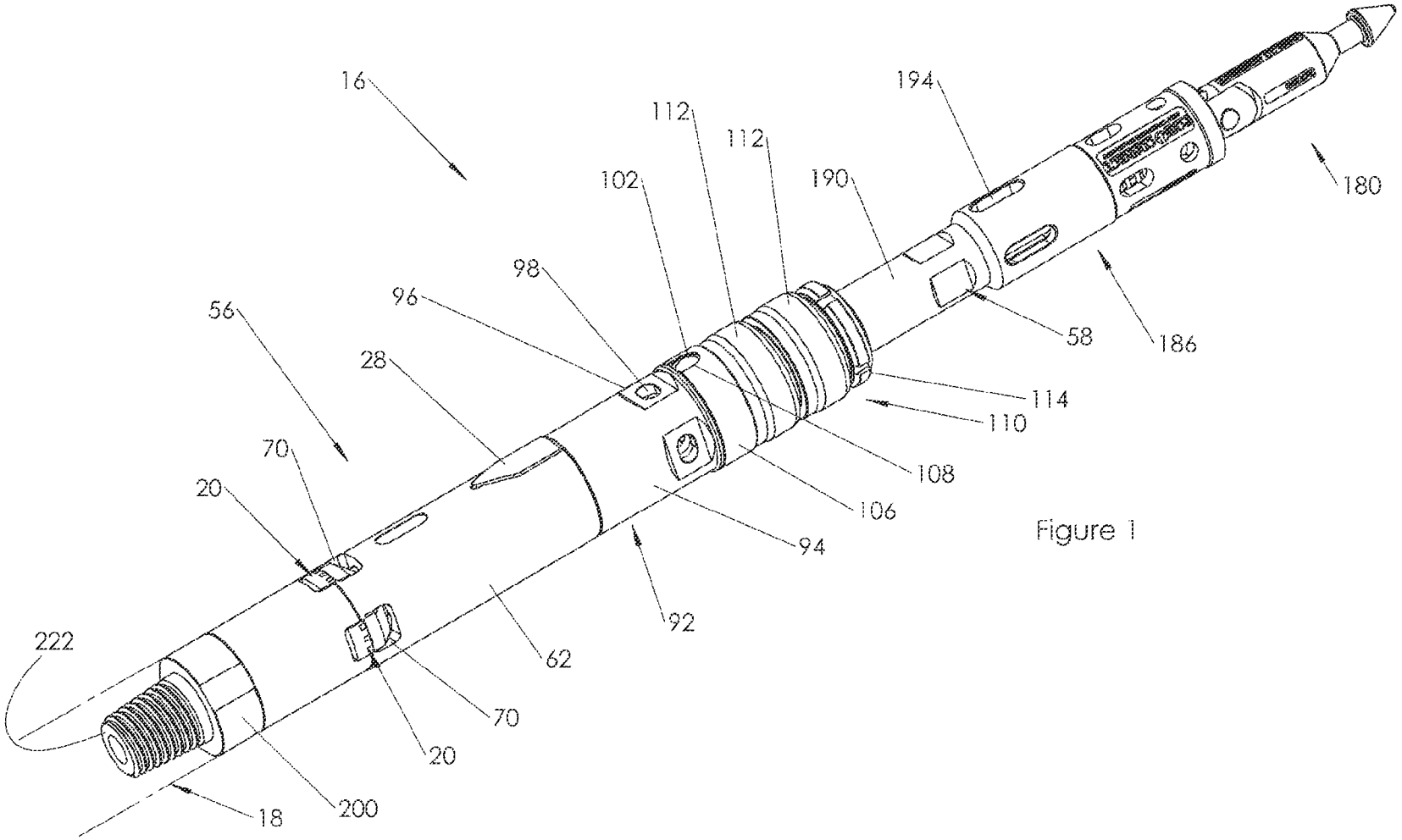
FIG. 1 is a schematic representation of a tool incorporated in an embodiment of the disclosed downhole device delivery and associated drive system.
Figure 10:
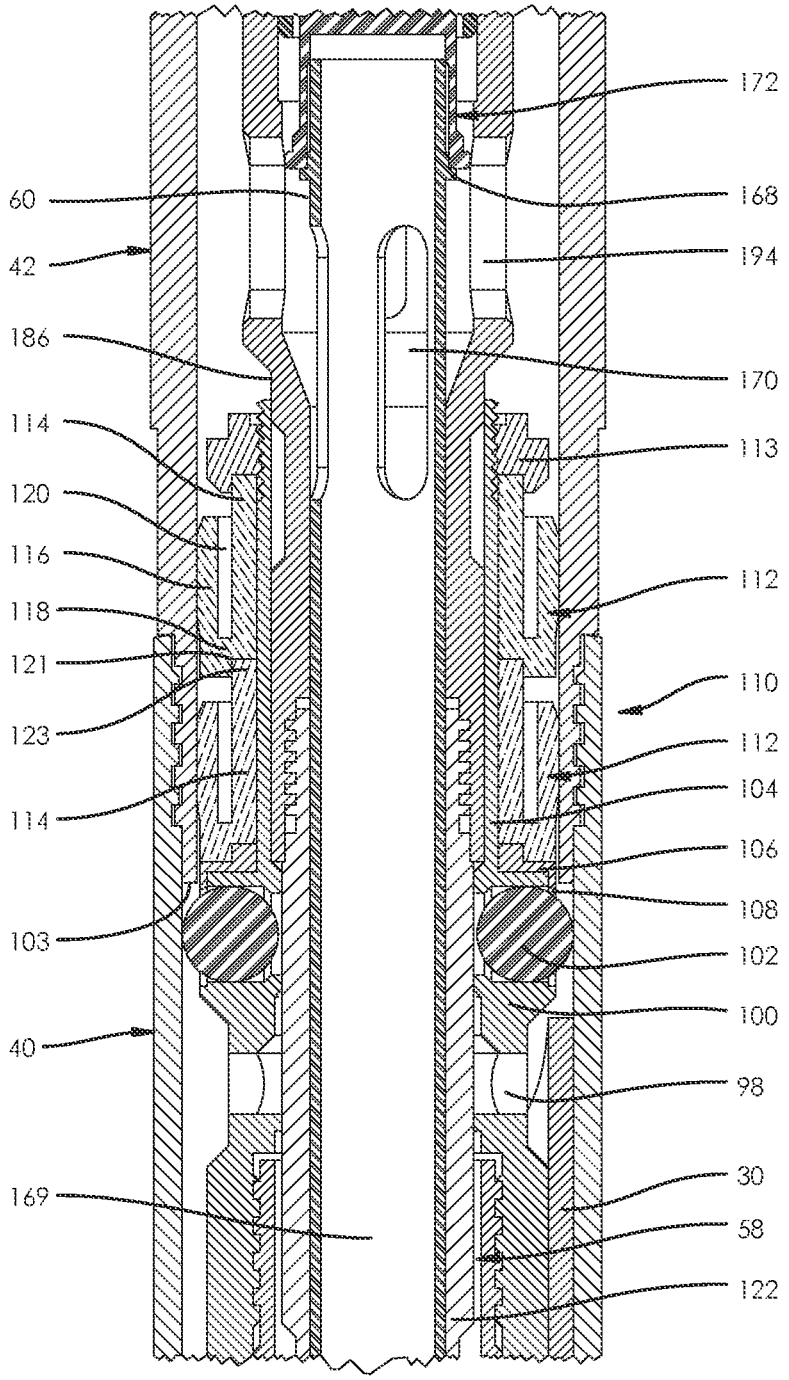
FIG. 10 is an enlarged view of a portion of the tool incorporated in the system.

Referring to FIGS. 1 and 10 a sealing arrangement 110 composed of two identical pump-in seals 112 fit onto the spigot 104 behind the locking ball sleeve 106. The locking ball sleeve 106 and sealing arrangement 110 are retained on the spigot 104 by a lock nut 113. The pump-in seals 112 are modified in comparison to prior art pump in seals. Each pump-in seal 112 has an inner annual a body 114 and an outer annular body 116 which are joined together at one end by a web 118. There is an annular gap 120 between the bodies 114 and 116. When the sealing arrangement 110 is in use fluid pressure acts on the gap 120 forcing the annular body 116 in a radial outward direction on a surface of the drill string 14 or the adapter sub 42. The modification of the seals 112 in comparison to prior art seals is the provision of a recess 121 at an end of the seals 112 adjacent to the web 118. The recess 121 opens onto an inner circumferential surface of the seal 112 and receives an upper end 123 of the inner body 114 of an adjacent pump-in seal 112.

Control Shaft 58

The control shaft 58 is an assembly of the following parts:

actuation tube 122;

O-ring 124;

valve seat 126;

valve 128;

valve spring 130; and reamer transition tube 132.

The actuation tube 122 is formed with a thread 134 at upper end then, moving in a downhole direction is formed with: a reduced diameter recess 136; an intermediate portion 138 formed with a plurality of bypass ports 140; a seat 142 for the O-ring 124; bleed holes 144, and finally a reduced diameter portion 146 is formed with an exterior and internal (not shown) screw thread. An axial passage 147 (see also FIGS. 2-4) extends through the actuation tube 122. The combination of the bypass ports 98 and 140; and the bleed holes 144 can be considered collectively as one or more openings of the fluid control system or the tool, at locations intermediate of up hole and downhole ends of the tool.

The valve seat 126 has a tubular portion 148 that screw onto the internal thread on the portion 146. A circumferential ridge 150 is configured to form a stop against the axial end part of the portion 146.

The valve disc 128 is biased by the spring 130 toward the valve seat 126. The valve spring 130 is retained between the valve disc 128 and the reamer transition tube 132. The combination of the valve seat 126, valve disc 128 and valve spring 130 forms a one-way valve 131.

The reamer transition tube 132 screws onto the reduced diameter portion 146 of the actuation tube 122. The reamer transition tube 132 is formed with an axial passage 152 (see also FIGS. 2-4) with an increased diameter part 154 and a reduced diameter part 156.

The reamer transition tube 132 has an upper cylindrical portion 160 formed with an internal thread which screws onto the external thread on the part 146. Downhole of the portion 160 is an intermediate portion 162 having an increased and constant outer diameter. This is followed by a frusto-conical portion 164 which reduces in outer diameter in a downhole direction and leads to a constant diameter tail 166. A shoulder 158 is formed at the junction of the increased diameter part 154 and reduced diameter part 156. The end of the spring 130 distant the valve 128 abuts the shoulder 158.

The sleeve 60 is in the form of an elongate tube having: an internal axial passage 169; and, an external circumferential ridge 168 near its up-hole end. A plurality of ports 170 is formed in the sleeve 60 near but downhole of the ridge 168. An end cap 172 is screwed onto the sleeve 60 and abuts the ridge 168. The end cap 172 is formed with a reduced diameter solid pin 174. The pin 174 has an external thread which couples to the tube 176 of spearpoint assembly 180. A bypass spring 182 sits on the tube 176 and bears at one end against a shoulder 184 of the end cap 172, and at an opposite end against an internal shoulder 185 of the spear point assembly 180.

Figure 7:
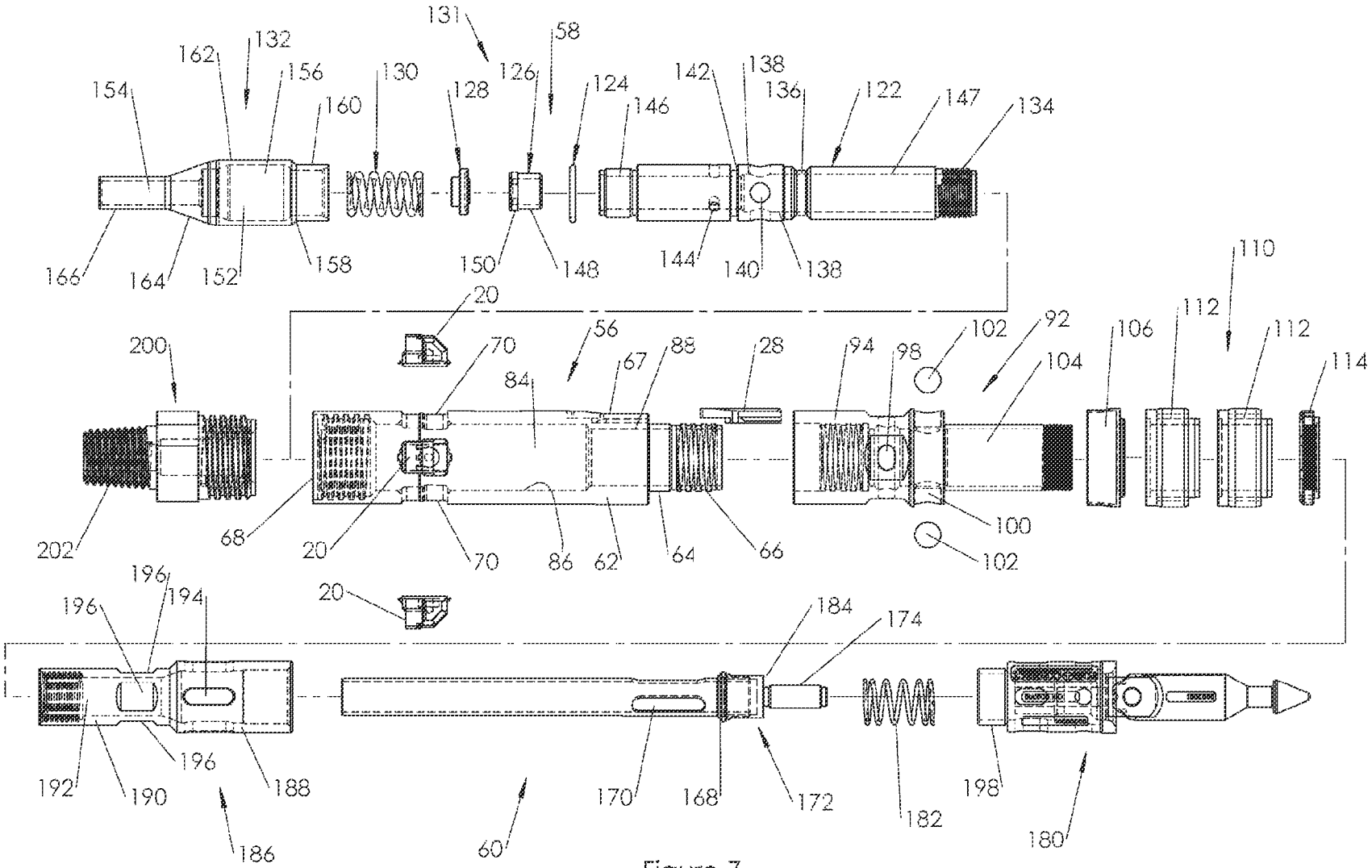
FIG. 7 is an exploded view of the tool shown in FIGS. 1-4.

With reference to FIGS. 4 and 7 the tool 16 includes a fluid inlet body 186 having an upper portion 188 and a coaxial but reduced diameter lower portion 190. A fluid flow passage 192 extends axially through the body 186 and a plurality of ports 194 is formed in the body portion 188 providing communication between the interior and exterior of the passage 192. A plurality of facets 196 is also formed in the portion 188 to assist a gripping tool (not shown) in gripping the body 186 to screw this onto or off of the actuation tube 122.

The spear point assembly 180 is formed with an external thread 198 at a downhole end that threateningly engages with a screw thread (not shown) on the inside of the body 188.

An adapter 200 screws into the downhole end 68 of the main body 56. A downhole end of the adapter 200 is formed with a threaded spigot 202 onto which the outer core barrel 18 is screw coupled. As shown in FIGS. 2-4 the adapter 200 is formed with a central passage 204 having an upper conical portion 206, a contiguous constant intermediate diameter portion 208 and a contiguous constant but reduced diameter portion 210. An internal shoulder 212 is formed between the portions 208 and 210.

The tool 16 has an axially extending fluid flow path 220 having an inlet formed by the ports 194 and a main outlet 222 at the downhole end of the adapter 200. The fluid flow path 220 is composed of the passages of several components of the tool 16. In particular the fluid flow path 220 includes the, or parts of the:

fluid flow passage 169 in the sleeve 60;
passage 147 in the actuation tube 122;
passage 152 in the reamer transition tube 132; and
passage 204 in the adapter 200.

As explained in greater detail below various parts of the tool 16 also cooperate with each other to form a fluid flow control system which controls the flow of fluid through the fluid flow passage 220.

The operation of the system 10 will now be described with particular reference to FIGS. 2-4. In describing the operation, it is assumed that the core barrel 18 is shown in FIG. 4 is attached to the tool 16.

FIG. 2 shows a tool 16 in a first or pump-in mode. In this mode the tool 16 is travelling through and along a drill string 14. The spear point assembly 180 may be attached to a wireline (not shown) and fluid is being pumped into the drill string 14. The main body 56 is locked to the control shaft 58. This locking is affected by the locking balls 102 which extend into and sit in the reduced diameter recesses 136 on the actuation tube 122. The tool 16 is arranged so that when travelling through the drill string 14 the locking balls 102 contact or are closely adjacent the interior surface of the drill string 14 so that they remain seated in the recesses 136. As a consequence, during the pump in mode the control shaft 58 cannot move axially relative to the main body 56.

The members 20 are retained on the tail 166 in registration with respective slots 70 in the main body 56. The small ramp 81 on the members 20 overlies an initial region where the tail 166 transitions to the frusto-conical portion 164. The members 20 are retained on the tail 166 by the respective magnets 73.

Also, while in the pump-in mode spring 182 biases the sleeve 60 to a position where the sleeve 60 covers the ports 140 in the control shaft 58. Additionally, the bleed holes 144 are covered and thus closed by the reduced diameter portion 88 of the main body 56. The one-way valve 131 is closed by action of the spring 130 pushing the valve 128 against the valve seat 126. Accordingly, fluid being pumped into the drill string 14 is able to flow into the fluid flow passage 220 via the ports 194 but is unable to open the one-way valve against the bias of the spring 130 and cannot otherwise flow out of the fluid flow passage 220. Therefore, the pressure of this fluid assists in causing the tool 16 to travel through the drill string 14.

Eventually the tool 16 reaches the end of the drill string 14 and enters the sub 12 which is coupled to the drill string 14 via the reamer sub 40 and the adapter sub 42. The key 28 will engage some part of the edge 26 of the sub 12 and, unless by chance it is axially aligned with the socket 34 and will ride down the edge 26 rotating about a longitudinal axis to align with, and seat in, the socket 34. This halts the axial travel of the tool 16 through the sub 12. Also, as seen most clearly in FIG. 10 there is an increase in the inner diameter of the reamer sub 40 in comparison to the adapter sub 42. This provides space for the locking balls 102 to move in a radial outward direction out of the recess 136, and creates an internal shoulder 103.

The tool 16 (in particular the main body 56), can no longer travel in the axial direction but fluid is continually being pumped into the drill string 14. There is therefore a progressive increase of fluid pressure on the one-way valve 131. This fluid pressure, which is being resisted by the spring 130 is transferred as a force on the control shaft 58 urging it to slide in a downhole direction relative to the main body 56. As the locking balls 102 are now in the increased diameter portion of the reamer sub 40, balls 102 can ride up the recess 136 as the inner control shaft 56 moves in the downhole direction relative to the main body 56.

This motion causes the following things to happen:

- the members 20 slide along the frusto-conical portion 164 and onto the intermediate portion 162 of the reamer transition tube 132, resulting in a radial outward displacement of the members 20 so that a circumferential surface of the reamer pads 72 lie proud of the drill string;
- the control shaft 58 moves in a downhole direction to the maximum extent where the tail 166 abuts the shoulder 212 and the frusto-conical portion 164 of the transition tube 132 seats in the cup portion 206 of the adapter 200, halting any further motion of the control shaft 58 downhole direction relative to the main body 56;
- the bleed holes 144 become uncovered and are thereby opened as they now lie within the increased diameter downhole portion 86 of the passage 84;
- with the control shaft 58 now unable to move in the downhole direction relative to the main body 56, further increase in the fluid pressure eventually overcomes the bias of the spring 130 and opens the one-way valve 131 as the valve disc 128 separates from the valve seat 126.

The fluid control system and indeed the system 10 are now in a drilling mode (which may also be referred to as a second mode or an operational mode) as shown in FIG. 3. In the drilling mode fluid flowing through the fluid flow path 220 can now flow through the main outlet 222, with a portion of fluid also flowing through the bleed holes 144 over and around the members 20. The portion of fluid flowing through the main outlet 222 is subsequently able to flow between the inner core barrel 19 and the outer core barrel 18 to provide cooling to the drill bit 22 and enable flushing of the borehole being drilled. The locking balls 102 act to hold the tool 16 in this disposition preventing it from being pushed back up the drill string while in the drilling mode because the locking balls cannot pass in an up-hole direction inside of the shoulder 103. In this way the tool is releasably latched in the drill string.

The combination of the locking balls 102, main body 56 and in control shaft 58 form a locking system. The locking system has a travel state and a latching state. The travel state coincides with the pump in mode and the trip out mode and exists while the tool 16 is delivering a device down the drill string or is in motion travelling back up the drill string to retrieve the device. In the travel state the inner control shaft 58 is located relative to the main body 56 so that the recesses 136 are aligned with the locking balls 102. When the tool 16 is travelling in the drill string the locking balls contact or at least are closely adjacent the inside wall of the drill string and therefore cannot move radially out of the recesses 136. This maintains a relatively juxtaposition of the inner control shaft 58 and the main body 56.

The locking system changes to the latching state locking balls 102 it travels to a position where the locking balls 102 are disposed down hole of the shoulder 103 as shown in FIGS. 3 and 10. The locking state of the locking system coincides with the second, operational, or drilling mode of the fluid control system. Due to the pressure of the fluid being pumped down the drill string and the additional space now provided within the sub 40 the inner control shaft 58 slides down hole direction relative to the main body 56 moving the locking balls 102 in a radial outward direction. Now the tool 16 is latched at the downhole end of the drill string because the locking balls 102 are unable to retract radially inward to pass in an up-hole direction within the shoulder 103. It should be recognised that the latching state also coincides with (a) the members 20 being engaged in the recesses of the drive sub and extending proud of the outer circumferential surface of the drill string; and (b) the key 28 being seated in the recess 34.

Figure 11:
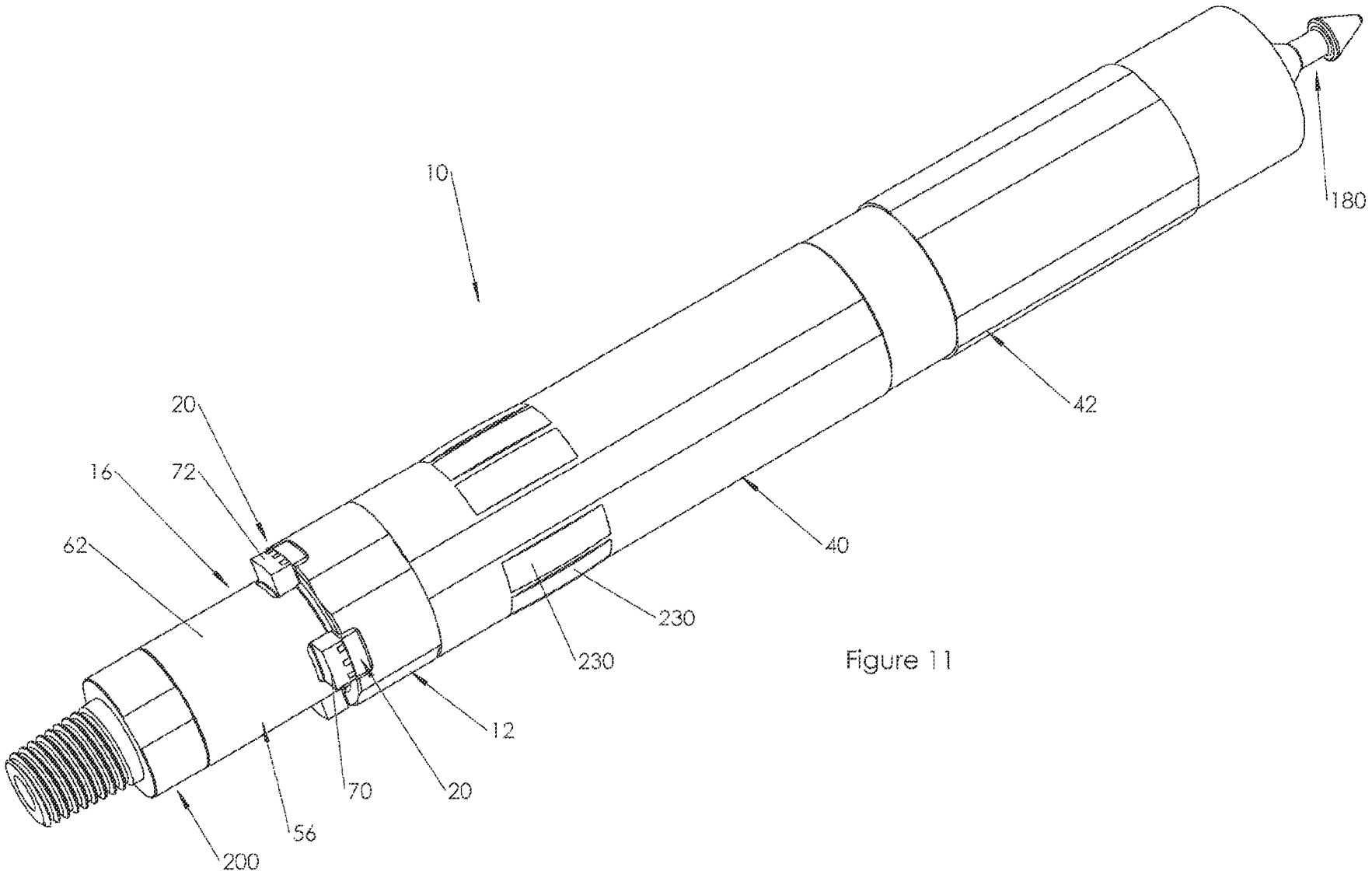
FIG. 11 is a representation of the disclosed system showing the tool engaged with the drive sub.

It should also be noted that when in the drilling mode the members 20 are now engaged in the recesses 48 of the sub 12 as shown in FIG. 11. Torque is designed to be transferred by the interaction of the key 28 and the recess 34 in the sub 12. The engagement of the members 20 in the recesses 48 is not intended, and does not need, to impart torque from the drill string to the tool 16 to cause rotation of the drill bit 22. Due to manufacturing tolerances there may be some a minor torque transfer from the sub 12 to the tool 16 through the members 20. As a result of the above described torque transfer the outer core barrel 18 and drill bit 22 rotate with the drill string 14. When the tool 16 is being used in a core drilling application the weight on the bit 22 (i.e. the downhole end or toe engaging end of the tool) is transferred to the sub 12 by the members 20. This is facilitated in this embodiment by way of engagement of the tapered surfaces 83 of the members 20 with the tapered surfaces 50 of the recesses 48.

During core drilling the inner core tube 19 is rotationally decoupled from the outer core barrel 18 for example by use of a swivel arrangement as is known in the art. Fluid flows down the drill string 14 into the ports 194 and 170 down the fluid flow path 220 with a first portion of the fluid flowing out of the main outlet 222, between the inner core tube 19 an outer barrel 18 and into the hole; with a controlled second portion of the fluid flowing through the flow path 220 being diverted through the bleed holes 144 over the members 20. This second portion of the fluid flow path insures a portion of the drilling fluid also always exists in the tool 16 at the reamer pad bits 72 to provide cooling cleared in lubrication even if a zone of broken or fractured ground is encountered which may otherwise result in partial or total loss of drilling fluid to the ground formation. This therefore minimises excessive borehole torque or drill rod chatter as well as mutual or severe reamer pad bit wear. The degree of split of the fluid between that passing through the bleed holes 144 to the members 20/reamer pad bits 72; and, flowing to the drill bit through the adapter 200 can be varied by design of the tool 16 to achieve any desired split. In one nonlimiting example the second portion of the fluid may be from about 2%-20% of the fluid entering the tool 16, the remaining first portion, being about 98%-80% of the fluid flows through the main outlet 222.

When a core run has been completed, i.e. when the inner core tube 19 is filled with a core sample or the drill has progressed a depth equal to the length of the last added drill rod the tool 16 together with the outer core barrel 18, inner core tube 19 and drill bit 22 is retrieved. This is done by ceasing the flow of fluid down the drill pipe and running an overshot on a wire line down the drill pipe 14 to engage with the spear point assembly 180. The wireline is then reeled in which initiates the following events:

a) the control shaft 58 slides in an up-hole direction relative to the main body 56 to a final position where the recesses 136 realigned with the locking balls 102, which allows the locking balls 102 to move radially inward so that they and the tool 16 can move in an up-hole direction past the shoulder 103, effectively unlatching the tool 16 for the drill string;

b) the force pulling upwardly on the control shaft 58 easily overcomes the magnetic attraction of the members 20 to the reamer transition tube 132 so the transition tube 132 moves in the up-hole direction and the members 20 slide down the frusto-conical portion 164 to lie on, and are magnetically held to, the tail 166;

c) the motion of the control shaft 58 in the up-hole direction relative to the main body 56 results in the bleed holes 144 closing as they are now covered by the inner surface of the main body 56, and the ports 98 are radially aligning with the ports 140;

d) the sleeve 60 is pulled away from and uncovers the ports 140 by virtue of the mass of the assembly plus the head of water acting on the spring 182 against the pull of the wireline. This now opens a seal bypass flow path through the aligned ports 98 and 140. So as the tool 16 is pulled upwardly through the drill pipe 14 the overlying head of fluid is able to flow through the ports 194 and 170, along the path 220 and out of the aligned ports 98 and 140 bypassing the sealing arrangement 110. This assists in reducing the retrieval time for the tool 16 as well as the load on the wireline and power requirement for an associated wireline winch.

The flow control system and indeed the tool 16 are now in a third or trip out mode as shown in FIG. 4. The tool 16 together with the members 20, and the core barrel 18, inner core barrel 19 and drill bit 22 are withdrawn from the drill string 14. The sub 12, reamer sub 40 and adapter sub 42 remain in the hole attached to the downhole end of the drill string 14.

To retrieve the core sample, the outer core barrel 18 is unscrewed from the core barrel adapter 200, the inner core barrel 19 can then be removed and the core sample extracted in a conventional manner. The drill bit 22 is inspected and if worn or the downhole geology has changed, can be replaced in the very next core run by simply detaching the worn drill bit 22 from the outer core barrel 18 and screwing on a new drill bit.

In order to change the reamer pads 72 the adapter 200 is unscrewed from the main body 56 and the fluid inlet body 186 is unscrewed from the actuation tube 122. The actuation tube 122 together with the attached reamer transition tube 132 is now pushed in the downhole direction so that members 20 ride up and over the transition tube 132 and actuation tube 122. The actuation tube 122 together with the attached reamer transition tube 132 is then extracted from the downhole end of the reamer body 62. The members 20 can then be extracted from the downhole end of the reamer body 62.

In order to install fresh members 20 having new reamer pads 72 the members 20 may initially be located within the slots 70 of the reamer body 62/main body 56 and retained in place by a ring having magnets for temporarily holding the members 20 in place. (Alternately the members 20 can be replaced by a use of the paste such as grease.) The assembly of the actuation tube 122 and the reamer transition tube 132 can insert back up the reamer body 62. The adapter 200 is screwed onto the end of the reamer body 62 and the fluid inlet body 188 is screwed onto the thread 134 on the actuation tube 122.

The general configurations similar to that shown in FIG. 2 with the exception that at this point in time, the tool 16 is not within the drill string 14 and the members 20 are held by the before mentioned ring (or grease) in an extended state through the slot 70 and therefore spaced from the tail 166. It should also be noted that the locking balls 102 are seated in the recess 136 of the actuation tube 122. Removing the ring releases the members 20 resulting in the members 20 collapsing onto the underlying tail 166. (If grease is used instead of the ring and the members 20 can be simply just pushed by finger to collapse onto the tail 166). The tool 16 is now in the pump in-mode ready for connection of an outer core barrel 18 (assuming the tool 16 is being used for a core drilling operation) and can be tripped down a drill string 14.

Therefore, at every core run (i.e. every time the core sample is extracted from the drill hole) it is possible to check and/or replace the members 20 and associated reamer pads 72 as well as the drill bit 22. To obtain the same functionality in terms of changing the drill bit 22 of a standard core drilling system one would need to trip the entire drill string 14 out and then back into the hole, drill pipe by drill pipe.

The reamer pads 72 and the members 20 maintain the gauge of a hole being drilled. As shown in FIG. 11 reamer pads 230 are embedded in the reamer sub 40. This is a known and standard arrangement. In one embodiment is possible to form the reamer pads 72 on the members 20 to have a slightly greater diameter than the reamer pads 230 so that the pads 72 are worn preferentially to the pads 230. This may enhance productivity and profit from a drill rig by avoiding, or at least reducing the frequency of, the need to trip the string 14 to change the reamer sub 40.

Whilst a specific system and method embodiment have been described, it should be appreciated that the system and method may be embodied in many other forms. For example, in the above embodiment the device carried by the tool 16 is a core barrel assembly which comprises the outer core barrel 18, inner core barrel 19 and drill bit 22. However, the tool 16 can carry different devices. In one example the device may be a wedging system (not shown) for the purposes of facilitating steering/directional drilling. In such an embodiment the wedging system is attached to the adapter 200 in place of the core barrel 18. The members 20 would not necessarily require reamer pads 72.

The wedging system is thus attached to the end of the drill string 14 without having to trip the string 14 as is currently required. Of course, when performing directional drilling using a wedging system it is necessary to know the rotational orientation or bearing of the wedging system. This is possible with embodiments of the system 10 when used in conjunction with a down the hole survey tool or orientation sensing system which can be keyed with the guide mechanism 24. Due to the operation of the guide mechanism 24 the rotational position of the tool 16, and thus the wedging system, will always be known relative to the drive sub 12 when the tool 16 is engaged with the sub 12. Therefore, by use of a surveying tool or other orientation sensing system keyed to have a known rotational position relative to say the socket 34 of the sub 12, and aligning the wedging system with the socket 34, the orientation sensing system will enable an operator on the ground to know the position of the wedging system.

In another variation the device carried by the tool 16 may be a sampling or non-sampling fluid driven hammer drill system (not shown), for the purposes of facilitating rapid borehole drilling through geological zones of low interest or where structural geological information is not a high priority. In such an embodiment the sampling or non-sampling fluid driven hammer drill system is attached to the adapter 200 in place of the core barrel 18. The members 20 would still require reamer pads 72 to correctly gauge the borehole and allow the drill string to advance while drilling.

By way of brief background, a fluid driven hammer drill system typically comprises an outer barrel, a fluid driven piston which can reciprocate within the barrel, and a hammer bit coupled to the outer barrel by a drive sub. Interposing grooves and splines on the drive sub and the hammer bit enable the hammer bit to slide axially relative to the drive sub while also transferring torque from the drill string via the outer barrel and drive sub to the hammer bit. Fluid delivered into the hammer drill system reciprocates the piston which is cyclically impacts on the hammer bit. These impacts are transmitted to the toe of the hole by the hammer bit causing fracturing of the strata. The construction and operation of fluid driven hammer drill systems is well known by those skilled in the art and therefore not described any further detail in the specification. Suffice to say that fluid driven hammer drill systems can be tripped through a drill string using the tool 16 in the same manner as the core drilling system described above.

The tool 16 with the coupled fluid hammer system forms a retractable hammer system that can be deployed at will by the drill operator as required by the geological client in unimportant or uninteresting zones of the borehole where structural or other geological information is considered to be of low value to significantly improve productivity and penetration rates compared to the coring mode described above and until geological zones of interest are reached. At which point the coring version of the system is deployed by the tool again.

This then provides what is believed to be a unique drilling method where a bore hole can be drilled using two fundamentally different drilling techniques without needing to pull the drill string from the bore bole. In this method of drilling the drilling technique is, or can be, changed between core drilling and hammer drilling by tripping the tool 16 and changing the type of device coupled to the adapter 200, i.e. either a core drilling system or a hammer drill system. When it is desired to change the drilling technique the tool 16 is simply retrieved and the device, be it the hammer drill system or the core drilling system swapped over for the other. As will be understood by those skilled in the art the fluid needed to drive the hammer drill system is facilitated by the tool 16 which allows for a flow of fluid axially through the tool 16 and into the device attached to the adapter 200. When the hammer drill system is used the fluid delivered down the drill string can also be used to carry drill cuttings to the surface, optionally for sampling.

In another variation the members 20 and the recesses 48 in the sub 12 can be configured to engaged each other to provide transfer of torque from the drill string to the device(s) being carried by the tool 16. Additionally, or alternately the tool may also include a second mechanism specifically to transfer torque from the drill string to the coupled device(s). This may take the form of drive dogs carried by the main body or the inner control shaft and corresponding slots or holes inboard of the edges of the sub, where the drive dogs can be selectively engaged with the slots or holes to transfer torque and disengaged to allow retrieval of the tool.

In a further variation the guide mechanism may be structured to guide the tool to one of a plurality of known rotational orientations relative to the sub as the tool travels into the sub. This variation can be achieved by forming the edge 26 they plurality of peaks 32 and troughs with a respective socket 34 in each of the troughs. For example, four peaks 32 can be provided equally spaced about the axis of the sub 12 so that the 49 orientations are 900 apart. This is an acceptable variation where the tool 16 is to deliver and operate devices in which knowing the precise orientation of the device is not critical to its overall functioning or the functioning of the drill string. This is the case for example when the device is a core drill. However, if the device being delivered by the system is one where having a single known orientation is required for example when the device is a wedge for use in directional drilling when this variation is not appropriate, and the embodiment shown in FIGS. 5*a* and 5*b* should be use which give a single known orientation.

Embodiments of the disclosed tool, system and method are described in relation to a drill string. However, embodiments may be used in relation to other types elongate conduits such as coiled tubes or pipelines.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the system and method as disclosed herein.

The invention claimed is:

1. A downhole device delivery and drive transfer system comprising:

a sub arranged to attach to a drill string;

a tool configured to travel through the drill string and into the sub when the sub is attached to the drill string; and a guide mechanism operable between the sub and the tool to guide the tool to a known rotational orientation relative to the sub as the tool travels into the sub, at which the tool is able to releasably couple to the sub, whereby the sub and the tool together form a torque transmission system so that torque imparted to the drill string is transferred by the sub to the tool, the tool further being arranged to carry one or more devices for performing one or more downhole functions, wherein the guide mechanism comprises a guide surface supported by the sub, and a key on the tool, the key being arranged to engage with the guide surface, wherein the tool is able to rotate about its longitudinal axis on engagement of the key with the guide surface, thereby to guide the tool to the known rotational orientation relative to the sub, and wherein the sub comprises a body of tubular structure with an uphole edge and a downhole edge, wherein the guide surface is formed as the uphole edge of the tubular structure, and wherein the downhole edge is provided with a plurality of circumferentially spaced recesses forming a castellated end.

2. The system as claimed in claim 1, wherein the tool comprises a plurality of coupling members configured to extend or retract in a radial direction relative to the tool, wherein the plurality of coupling members are arranged to engage the recesses in the downhole edge of the sub thereby to couple the tool to the sub, and wherein the plurality of coupling members are able to retract from the recesses thereby to release the tool from the sub and to enable passage of the tool through the drill string.

3. The system as claimed in claim 2, wherein torque imparted to the drill string is transferred by the sub to the tool by the engagement of the plurality of coupling members within the recesses.

4. The system as claimed in claim 2, wherein the guide surface leads into a socket configured to receive the key and wherein torque imparted to the drill string is transferred by the sub to the tool by the engagement of the key within the socket.

5. The system as claimed in claim 2, wherein the tool comprises drive dogs that are able to be selectively engaged and disengaged with slots formed in the sub, wherein torque imparted to the drill string is transferred by the sub to the tool by the engagement of the drive dogs within the slots.

6. The system as claimed in claim 2, wherein, when the tool is coupled to the sub, the plurality of coupling members extend radially beyond an outer circumferential surface of the sub.

7. The system as claimed in claim 2, wherein the tool comprises an inner control shaft axially movable relative to the tool, wherein the inner control shaft is movable between a first position, in which the inner control shaft urges the plurality of coupling members to engage the recesses in the downhole edge of the sub, and a second position in which the plurality of coupling members are able to retract from the recesses.

8. The system as claimed in claim 7, wherein the plurality of coupling members are magnetically coupled to the inner control shaft.

9. The system as claimed in claim 2, wherein the plurality of coupling members comprise reamer blocks or pads.

10. The system as claimed in claim 2, wherein each coupling member comprises a reamer support body and a reamer block or pad fixed to the reamer support body.

11. The system as claimed in claim 2, further comprising a fluid flow control system enabling control of the flow of fluid through the tool, the flow control system having a pump in mode enabling fluid to flow into but not out of the tool;

a drilling mode enabling fluid to flow in an axial direction through the tool; and a trip out mode enabling fluid to flow out of the tool through one or more bypass ports at a location intermediate of opposite axial ends of the tool.

12. The system as claimed in claim 11, wherein the fluid flow control system is arranged, when in the drilling mode, to enable a portion of the fluid to flow through one or more bleed holes and exit the tool at a location adjacent the coupling members.

13. The system as claimed in claim 12, wherein, when the fluid flow control system is in either the pump in mode or the trip out mode, a part of the tool closes off the one or more bleed holes.

14. The system as claimed in claim 1, wherein the one or more devices to be carried by the tool is one of (a) a drill bit, and (b) a core barrel assembly comprising an outer core barrel, an inner core barrel and a drill bit.

15. A method of delivering one or more devices to a downhole end of a drill string to perform one or more downhole functions and to transfer torque from the drill string to the one or more devices, the method comprising:

providing a sub attached to the downhole end of the drill string, wherein the sub comprises a body of tubular structure with an uphole edge and a downhole edge, wherein the uphole edge forms a guide surface, and wherein the downhole edge is provided with a plurality of circumferentially spaced recesses forming a castellated end;

delivering a tool through the drill string and into the sub, wherein the tool is arranged to carry the one or more devices, and the tool has a key being arranged to engage with the guide surface;

guiding the tool to a known rotational orientation relative to the sub as the tool travels into the sub, whereby the key engages the guide surface to rotate the tool about its longitudinal axis; and releasably coupling the tool to the sub in the known rotational orientation, so that torque, when applied to the drill string, is transferred by the sub to the tool and the one or more devices.

* * * * *